United States Patent [19]

Dini

[11] 3,981,238

[45] Sept. 21, 1976

[54] METHOD AND APPARATUS FOR DETERMINING DOCTOR BLADE POSITION IN A ROTOGRAVURE PROCESS

[75] Inventor: Mamiliano Dini, Elba, Italy

[73] Assignee: European Rotogravure Association, Munich, Germany

[22] Filed: June 6, 1975

[21] Appl. No.: 584,534

Related U.S. Application Data

[63] Continuation of Ser. No. 400,196, Sept. 24, 1973, abandoned.

[30] Foreign Application Priority Data

Sept. 27, 1972 Germany ..... 2247351

[52] U.S. Cl. ..... 101/154; 101/157; 101/169; 101/335; 101/364

[51] Int. Cl.[2] ..... B41F 9/10

[58] Field of Search ..... 101/DIG. 22, 142, 202, 101/206, 207, 208, 348, 349, 350, 365, 366, 364, 335, 154, 157, 169; 350/6, 7, 285, 299, 301; 356/161

[56] References Cited

UNITED STATES PATENTS

| | | | |
|---|---|---|---|
| 2,969,016 | 1/1961 | Crosfield et al. | 101/202 |
| 3,017,512 | 1/1962 | Wolbert | 356/161 |
| 3,234,821 | 2/1966 | Ostwald | 101/142 |
| 3,238,839 | 3/1966 | Day, Jr. | 88/14 |
| 3,330,961 | 7/1967 | Juengst et al. | 250/219 |
| 3,376,426 | 4/1968 | Frommer et al. | 250/226 |
| 3,392,623 | 7/1968 | Walker et al. | 350/96 R X |
| 3,439,175 | 4/1969 | Kammuller et al. | 250/218 |
| 3,449,758 | 6/1969 | Lavine | 350/299 X |
| 3,492,491 | 1/1970 | Beeit | 356/161 X |
| 3,667,421 | 6/1972 | Bala et al. | 118/7 |
| 3,707,123 | 12/1972 | Heasman et al. | 101/207 |
| 3,720,163 | 3/1973 | Frey et al. | 101/157 X |
| 3,729,248 | 4/1973 | Beduchand | 350/7 |
| 3,764,192 | 10/1973 | Wheeler | 350/7 |
| 3,783,781 | 1/1974 | Grommek | 101/157 |
| 3,813,140 | 5/1974 | Knockeart | 350/7 |

*Primary Examiner*—Edgar S. Burr
*Assistant Examiner*—Paul J. Hirsch
*Attorney, Agent, or Firm*—Cushman, Darby & Cushman

[57] ABSTRACT

A method and apparatus for determining the relative position between a doctor blade and a printing cylinder in a rotogravure printing process in which the thickness of the layer of residual ink which is allowed to pass by the doctor blade is used as a control valve. The thickness of the residual ink is determined by determining the amount of the attenuation caused by the residual ink to a beam of light. In one embodiment a laser beam is impinged upon the residual ink on the printing cylinder and the portion of the laser beam which is reflected, absorbed, and scattered by the residual ink and the printing cylinder is detected. The thus detected light can be compared to a reference value for determining the attenuation due to the residual ink layer and hence determining the thickness of the ink layer. The thickness of the ink layer can in turn be used as a control value for adjusting the position of the doctor blade with respect to the printing cylinder.

25 Claims, 3 Drawing Figures

Figure 1:
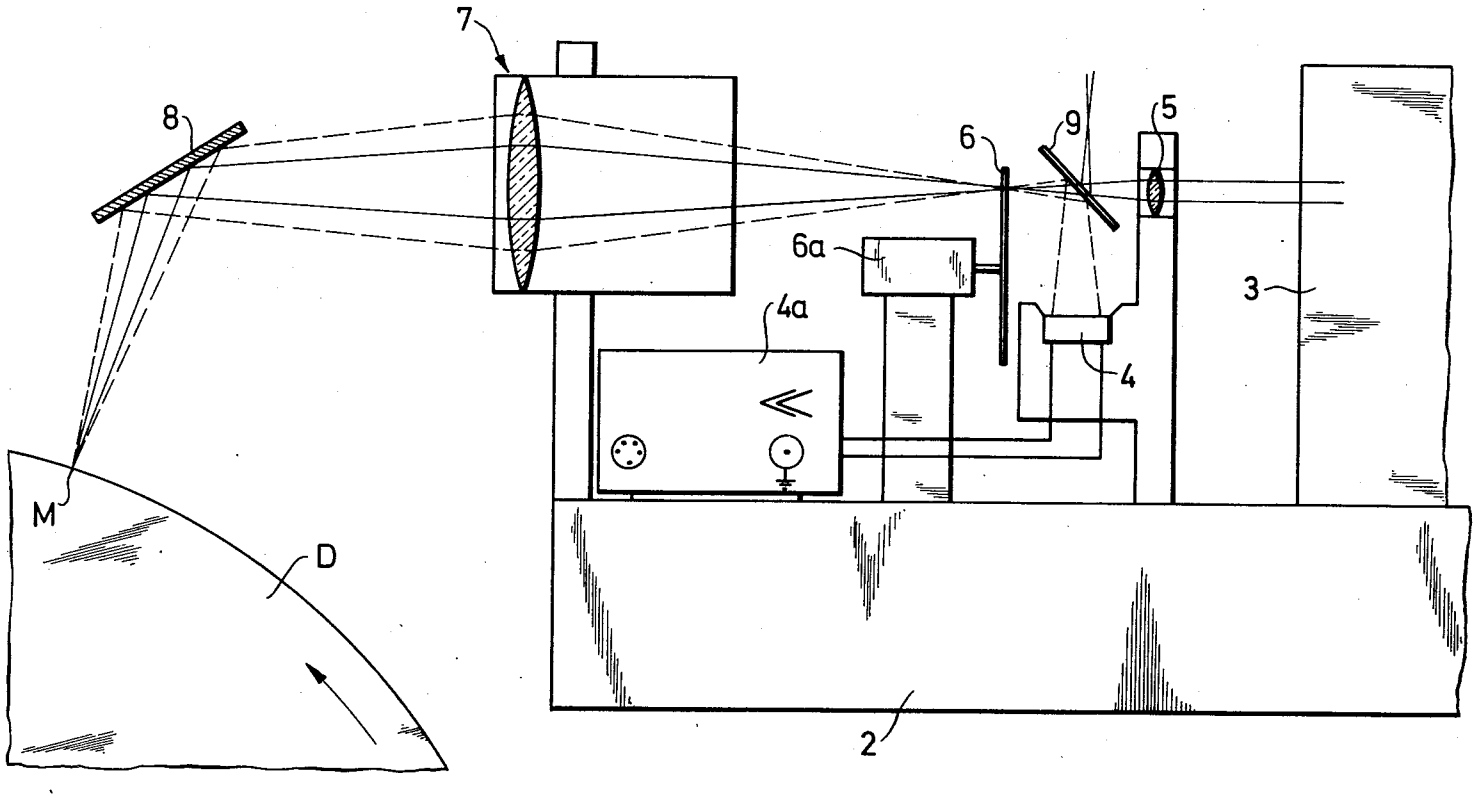

METHOD AND APPARATUS FOR DETERMINING DOCTOR BLADE POSITION IN A ROTOGRAVURE PROCESS

This is a continuation, of application Ser. No. 400,196 filed Sept. 24, 1973, now abandoned.

As is known, in the doctor blade rotogravure printing process, the ink is transferred from the inking pot to the printing cylinder in surplus amount and stripped off by a doctor blade in as far as it does not fill out the engraving cells. The doctor blade should not directly contact the surface of the printing cylinder as, otherwise, wear of material would occur. On the other hand, the doctor blade should not be too far away from said surface as, otherwise, too much surplus ink will remain on the surface of the printing cylinder and will tint the underground of the prints in a distrubing way. Therefore, under normal operational conditions, the width of the gap between the edge of the doctor blade and the printing surface is adjusted so that the entire surface of the printing including those areas which do not print is covered with an extremely thin ink layer of about 1 to 2 $\mu$. This ink skin serves as a sort of gliding aid for the doctor blade and to avoid any sucking out of the engraving cells by the doctor blade, and — on the other hand — is so sparsely inked that it does not tint the printed copies in a disturbing way.

Until now, the optimal distance between the doctor blade and printing cylinder has been manually adjusted by the printer on the basis of visual control and, accordingly, has depended on the experience and operating skill of the printer.

The invention now shows a way of avoiding this subjective estimation of the position of the doctor blade and replacing it by an objective measurement, eventually and preferably bringing about automatic adjustment of the position of the doctor blade to a predetermined value.

Accordingly, in one aspect the invention consists of a method of determining and eventually automatically adjusting the relative position between a doctor blade and printing cylinder in the doctor blade rotogravure printing process and is primarily characterized in that the thickness of the layer of residual ink which is allowed to pass by the doctor blade is used as the control value. Said layer thickness can be measured, for example, by a capacity method. However, a preferred embodiment of the invention consists in using the ability or power respectively of the ink layer to weaken or attenuate monochromatic light rays, especially laser rays, as said control value. Said weakening power comprises the absorption as well as the scattering of light rays and depends on various factors, such as the superficial state of the cylinder surface, i.e. its roughness, and the composition of the printing ink, e.g. of the pigment contained therein. However, said side factors can be determined in advance and taken into account as constants.

In another aspect the invention consists of an installation for performing the preferred embodiment of the method characterized and explained in the preceding paragraph. The characteristic constituents of said installation are a laser generator, a photo transformer and laser ray guiding elements, which are arranged in the path of rays between the laser generator and measuring spot on the surface of the printing cylinder on the one hand and between said measuring spot and the photo transformer on the other hand.

Said ray guiding elements consist of optical or electromagnetic lenses and mirrors which are adapted to direct the rays onto the measuring spot in the form of a sharply focussed light spot and to guide the light bundle which is reflected from the measuring spot, and thereby somewhat dispersed, to the receiving area of the photo electric transducer, the size of which is correspondingly properly chosen. Principally, each of these two optical tasks can be coordinated to its own optical system. However, according to a preferred embodiment of the invention both ray paths are guided predominantly along one and the same axis by the aid of the same ray guiding elements and are split off by the aid of a known ray dividing means, which is arranged in the proximity of the starting point of the rays, i.e. the source of the rays, and the terminal point of the rays, i.e. the receiving area of the photo electric transducer. The advantage of said kind of ray guidance consists not only in that ray guiding elements, such as collecting lenses and diverting mirrors, are saved, but also especially in the possibility of guiding the measuring beam into the space between the printing cylinder and the paper press roller, said gap being very limited in the case of the usual printing machines, and onto the rather narrow mantle zone of the printing cylinder between the contact line of the doctor blade and the line of ink transfer, and in mounting the comparably bulky measuring installation outside and narrow area. In this case, it is sufficient to, for example, mount a reflecting element, e.g. in the form of a small planar mirror, within said narrow area.

Evidently the measuring spot must be in an area of the printing cylinder which is not occupied by engraving cells. Said areas comprise the zones at the two ends of the cylinder as well as the interstices between the individual objects to be reproduced, that is, for example, between the sets of pages in the case of book printing.

If one is content with measuring the relative position between the doctor blade and the surface of the printing cylinder at but one location along the edge of the doctor blade or respectively the axis of the printing cylinder, the measuring beam is kept at one point of the axis so that, on rotation of the printing cylinder, the beam essentially runs along one and the same circumferential line and delivers practically constant values for the thickness of the residual ink layer. Said values themselves will appear as a constant output signal of the photo transducer or respectively the amplifier which is usually coordinated to said transformer.

Because, understandably, the relative position between the doctor blade and the surface of the printing cylinder will only change over long periods, in practice the constant control as discussed above is not necessary. However, it is sufficient that the installation is designed to provide descriptions of state which can be read and must eventually be obeyed by the printer or to give orders for the automatic adjustment of the printing device at appropriate intervals of time.

It is also within the scope of the invention to keep the periods of deliverance of measuring values comparatively short, that is, to impinge the measuring spot in pulses instead of constantly. For said kind of procedure there are two principal embodiments. The first way consists in that the laser source is operated to give a permanent beam and that said constant beam is periodically masked out by the aid of electromagnetically or mechanically operating interrupters at some location in the path of rays between the source of rays and the photo electric transducer. Said interrupter may be, for example, a known perforated or slotted disk. The second way, which is advantageous because of savings in energy, consists in the use of a so-called pulse laser, the impulse frequency of which is adapted to be electronically controlled within wide limits — as is well known.

In the case of the embodiments already mentioned previously, wherein the paths of rays are largely coaxial, a beam separating means is necessary. Said means can be of either optical or electromagnetical nature. In the first case it may consist of a known and customary semi-transparent mirror, which is inserted in the path of rays at an angle of 45°, and in the second case it may consist of a semi-permeable hollow conductor also known per se.

The photo electric transducer can consist of a photo cell, a photo diode, or a photo transistor having amplifying capacity.

The formerly mentioned reflecting element which directs the laser beam into the narrow area of the printing machine is preferably mounted to be pivoted for adjusting the measuring beam onto a predetermined measuring area on the printing cylinder.

Though it is true that for the preceding description of the invention it has been assumed that only one single measuring spot exists along the axis of the printing cylinder, it is obviously within the scope of the general inventive idea to distribute a plurality of such measuring spots on the surface of the printing cylinder and to subject them to measurement by choice or in a predetermined timed sequence by the aid of known supplemental ray directing means. Thereby, it is possible to determine the relative position between the doctor blade and the surface of the printing cylinder at a plurality of locations along the axis and, thereby, to recognize in good time local differences in width of the gap. It is known that the provision and maintenance of a gap width which is constant along the axis is becoming more difficult with increasing length of the printing cylinder.

The change-over done either by choice or automatically from one measuring spot to another can be effected in various ways. For example, a parallel bundle of laser rays may be directed onto a planar mirror arranged at an angle of 45° within the area of one side of the printing cylinder and, thereby turned round in the direction of the axis. Additionally, an optical bench is mounted parallel with the cylinder axis. On this bench a plurality of planar mirrors are mounted, each one of which is arranged at an angle of 45° with respect to the axis of the printing cylinder at a predetermined measuring spot thereon, and adapted to be swung in and out of optical alignment with the planar mirror at one side of the printing cylinder. Thus, the bundle of rays is directed onto the cylinder surface at different locations along the cylinder by each of such pairs of mirrors known as such. Each of said pairs of mirrors is coordinated to an optical focussing system which focusses the rays to form a light spot at the coordinated measuring spot. Obviously, rays directing means of the fiber optics type can also be used instead of the pairs of deflecting mirrors.

It is self-evident that the measured attenuation values which are associated with the individual measuring spots appear as output signals which are recognizable and which are adapted for control purposes in a correspondingly differentiated manner.

In the following by the aid of drawings an embodiment of the invention which has proved its efficiency in tests is explained in detail.

In FIG. 1 a schematical view of the arrangement of an installation for measuring the residual film thickness by a laser beam according to the invention.

Figure 2:
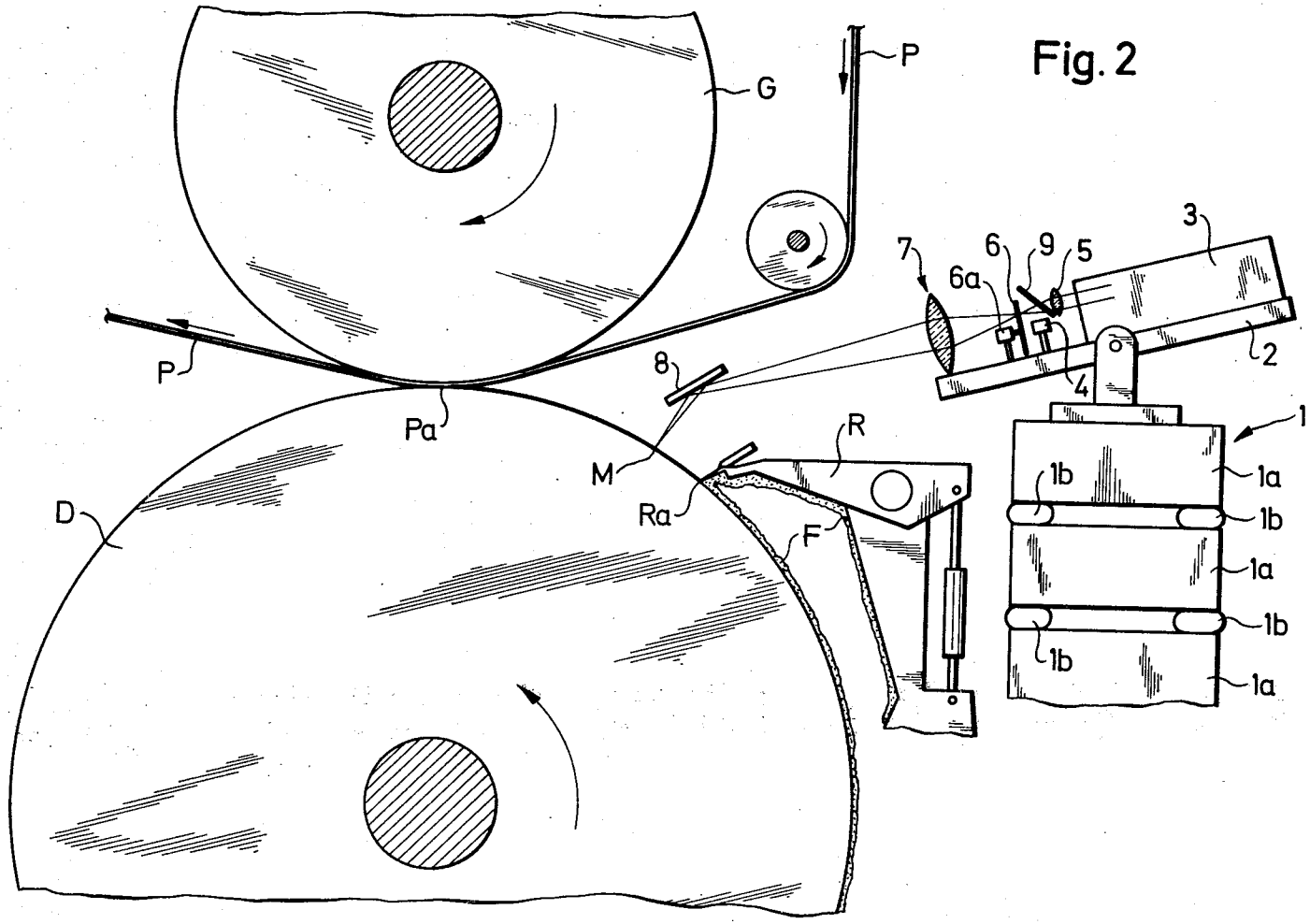

In FIG. 2 likewise a schematical view from which the spatial coordination between the measuring installation according to the invention and the printing machine can be seen.

Figure 3:
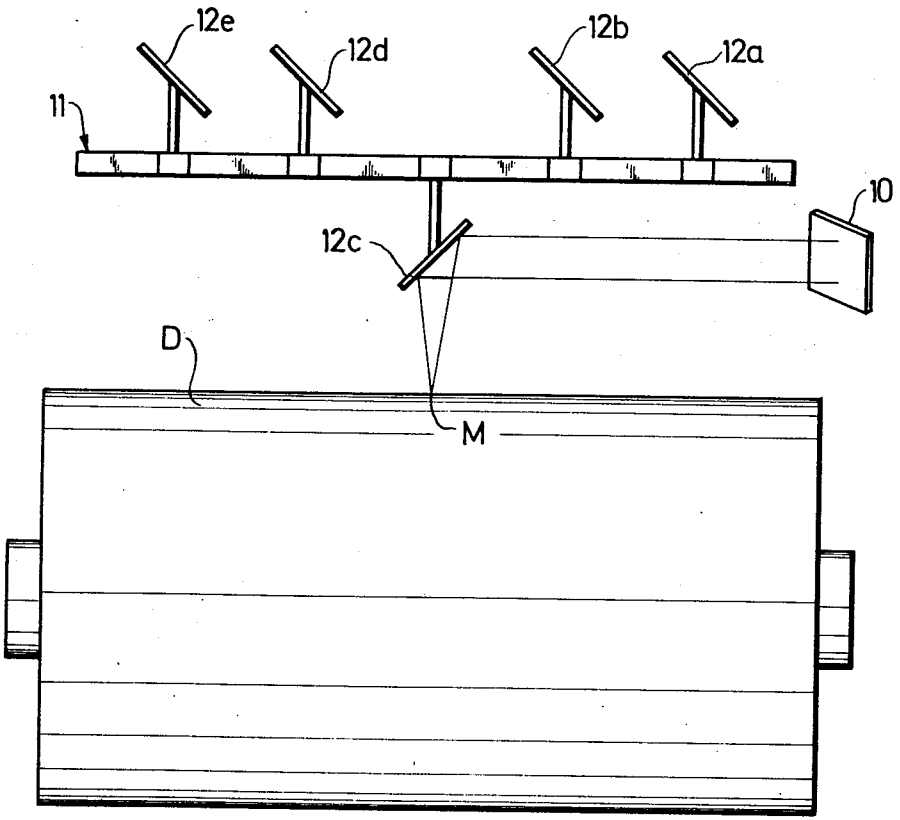

In FIG. 3 a schematical view of apparatus in accordance with one embodiment of the invention for measuring residual film thickness at a plurality of locations along the axis of the printing cylinder.

On a postament 1, which is practically free of oscillations and which consists of superimposed concrete plates 1 a and rubber plates 1*b* adapted to dampen oscillations, a base plate 2 is pivotally mounted. The plate carries a constantly radiating He-Ne-laser generator 3 of a known kind of design and operation, which serves as the measuring beam generator, and a photo electric transducer 4 including its coordinated amplifier 4a, which receives on its receiving surface the measuring beam which is reflected from the measuring spot M on the printing cylinder D and provides an electric output signal equivalent to the intensity of said measuring beam. The photo electric transducer is also of the usual design and kind of operation. According to FIG. 1 the path of the measuring beam passes from right to left from the laser generator 3 to the measuring spot M and in the opposite direction, i.e. from left to right, from said measuring spot M to said photo transformer 4. By the aid of a collecting lens 5 the beam which is emitted from the generator 3 is focussed in the plane of an interrupter disk 6, which is provided with four circumferential teeth and rotated at 300–400 Hz by a motor 6*a*, and thereby the beam is correspondingly pulse modulated. Subsequently, the beam is focussed on the measuring spot M by the aid of an optical system 7. Said system has a comparatively wide opening so that the measuring beam which is reflected by the measuring spot and thereby made somewhat more divergent can pass in its full extent. In order to adjust by choice the point on which the measuring beam impinges on the printing cylinder D a diverting mirror 8, which is pivotally mounted, is inserted in the path of rays between the optical system 7 and the measuring spot M. As can easily be seen from FIG. 1, the two paths of rays, one of which passes from the generator 3 to the measuring spot M and the other from said spot M to the photo transmitter 4, are predominantly coaxial and are only separated from one another in the path section between the interrupter disk 6 and the collecting lens 5 by a semi-transparent mirror 9 arranged under an angle of 45°, said mirror being the usual embodiment of a ray divider.

The electrical output signal delivered by the photo transformer 4 may be made visible on an oscillograph — which is not shown — so that, for example, the signal which is caused by the measuring beam which is reflected by the ink-free surface of the printing cylinder is used as the zero value, i.e. as the base line of the oscillograph display, and that the amplification of the output signal in conformance with the increasing thickness of the residual ink layer on the printing cylinder D is used as the measuring value for said thickness, whereby said amplification becomes recognizable on the oscillograph by a corresponding increase in elevation of the indicating line. Exceeding or falling short of the predetermined norm of said thickness measuring value can be used to provide manual or automatic re-adjustment of the position of the doctor blade.

With restriction to those parts of the measuring installation according to the invention and printing machine which are necessary for understanding same, FIG. 2 shows a special coordination of those parts with respect to one another which has been tested in practice. Of the printing machine of usual design the printing cylinder D, the doctor blade R, which keeps back the surplus of the printing ink F, the paper web P, and the press roll G are shown. The measuring spot M on the printing cylinder D is located on the short circumferential portion between the doctor blade contacting line Ra and the paper web contacting line Pa. By a corresponding slanting arrangement of the base plate 2 on the postament 1 the measuring installation is aligned so that the measuring beam is directed onto the diverting mirror 8, which is mounted on the printing machine, and from said mirror 8 onto the measuring spot M.

In FIG. 3 there is shown an arrangement in accordance with one embodiment of the invention for directing the laser beam onto a plurality of spots on the printing cylinder D. In this embodiment a reflecting mirror 10 is disposed at one end of the printing cylinder D and is disposed at a 45° angle with respect to an incoming laser beam so that the laser beam is reflected parallel to the axis of the printing cylinder D. An optical bench 11 is suitably mounted parallel to the axis of the printing cylinder D. On this optical bench a plurality of planar mirrors 12*a*, 12*b*, 12*c*, 12*d* and 12*e* are mounted, each one of which is arranged at an angle of 45° with respect to the axis of the printing cylinder and which are adapted to be swung in and out of optical alignment with the planar mirror 10 at one side of the printing cylinder. In FIG. 3, mirrors 12*a*, 12*b*, 12*d* and 12*e* are shown rotated out of optical alignment with the mirror 10 with the mirror 12*c* being shown rotated to a position where it is in optical alignment with the mirror 10. The mirror 12*c* is thus in a position where it receives the laser beam reflected by mirror 10 and in turn reflects it down ward to a focussed position on the surface of the printing cylinder D. In this manner each of the mirrors 12a through 12e can be selectively rotated into optical alignment with the mirror 10 for focussing the laser beam and receiving the reflected portion of the laser beam at a plurality of spots on the printing cylinder D along its axis.

As mentioned before, fiber optics can also be utilized for channeling the laser beam to a plurality of spots along the surface of the printing cylinder and receiving back therefrom the reflected portion of the laser beam.

What is claimed is:

1. A method for determining and automatically adjusting the relative position between a doctor blade and printing cylinder in a doctor blade rotogravure printing process using only a light beam in direct contact with the printing cylinder said method comprising:

transferring ink onto a rotogravure printing cylinder in surplus amounts;

stripping off all but a residual ink film portion of the surplus ink by the doctor blade leaving engraved cells in said printing cylinder substantially loaded with ink and also leaving said residual ink film on the non-engraved portions of said cylinder;

determining the thickness of the layer of residual ink film which passes by the doctor blade by directing an incident light beam through said residual ink film, reflecting the incident light beam from said predetermined non-engraved portions of said rotogravure printing cylinder back through said residual ink film a second time and sensing the resulting attenuated intensity of the reflected light beam which has thus been attenuated by two passages through said residual ink film to a degree representative of the thickness of said ink film; and utilizing the sensed thickness as a control parameter in adjusting the relative position of the doctor blade in response thereto.

2. A method in accordance with claim 1 wherein the thickness of the residual ink film is determined by determining its attenuation and scatter of monochromatic light rays.

3. A method in accordance with claim 1 wherein the thickness of the residual ink film is determined by its attenuation and scatter of laser rays.

4. A method for determining and adjusting the relative position of a doctor blade with respect to a printing cylinder in a doctor blade rotogravure printing process, said method comprising:

transferring ink onto a rotogravure printing cylinder in surplus amounts;

stripping off all but a residual ink film portion of the surplus ink by the doctor blade leaving engraved cells in said printing cylinder substantially loaded with ink and also leaving said residual ink film on the non-engraved portions of said printing cylinder;

directing an incident light beam onto said printing cylinder in said non-engraved portions of the cylinder at a location downstream of said doctor blade through the residual ink film at predetermined areas thereof;

attenuating said incident light beam by passage through said residual ink film;

reflecting the attenuated incident light beam from said predetermined non-engraved areas of the rotogravure printing cylinder;

further attenuating the reflected light beam by passage through said residual ink film the second time;

collecting said reflected light beam and redirecting same away from said printing cylinder and onto a light sensitive element;

sensing the intensity of said reflected, collected and redirected light beam, the intensity of said reflected beam having been doubly attenuated by said residual ink film to a degree that is dependent upon the thickness of said residual ink film;

deriving a control quantity from said sensed intensity of the reflected light beam representing the degree of attenuation and scatter doubly effected by said residual ink film and hence representing the thickness of said residual ink film; and adjusting the position of said doctor blade in accordance with said derived control quantity to maintain a desired relative position thereof with respect to the rotogravure printing cylinder.

5. A method as in claim 4 wherein said light beam is generated by a laser.

6. A method as in claim 4 including the step of comparing the attenuated and scattered beam to a reference value for determining that proportion of the attenuation and scatter of the beam which is due solely to the residual ink film.

7. A method as in claim 6 further including the step of generating a control signal for use in adjusting the position of the doctor blade with respect to the printing cylinder.

8. A method as in claim 4 wherein said directing and sensing steps comprise the steps of:

impinging a laser beam through the residual ink film onto the printing cylinder at a plurality of locations thereon, detecting the laser beam after it has been attenuated at the plurality of locations, and determining the position of the doctor blade with respect to the printing cylinder at the plurality of locations.

9. Apparatus for determining the relative position between a doctor blade and an engraved rotogravure printing cylinder in a doctor blade rotogravure printing apparatus wherein ink is transferred onto the rotogravure printing cylinder in excess amounts and all but a residual ink film portion of the surplus is stripped off by the doctor blade leaving engraved cells in said printing cylinder substantially loaded with ink and also leaving said residual ink film on the non-engraved portions of said cylinder said apparatus comprising:

a laser generator for generating incident light beam rays, incident ray guiding means for impinging the incident beam of rays on a predetermined measuring spot on the rotorgravure printing cylinder in a non-engraved area thereof through the residual ink film so that the residual ink film on the rotogravure printing cylinder attenuate and scatter the incident beam of rays by passage through the ink film and which incident beam is then reflected, attenuated and scattered by the printing cylinder and again further attenuated and scattered by passage again through the ink film to form an attenuated and scattered reflected beam of light rays having an intensity representative of the thickness of said residual ink film, a photoelectric transducer, reflected ray guiding means functioning to direct the reflected beam of rays onto said photoelectric transducer.

10. Apparatus in accordance with claim 9 wherein said incident and reflected ray guiding means are designed and arranged so that said two groups of rays are coaxial for the major part, and wherein said reflected ray guiding means includes ray separating means for splitting up said incident and reflected beams of light rays with respect to their source and termination respectively.

11. Apparatus in accordance with claim 9 including means for generating periodical pulse-like output signals from the photoelectric transducer.

12. Apparatus in accordance with claim 11 wherein said laser generator comprises a pulse laser which radiates in pulses.

13. Apparatus in accordance with claim 11 wherein said laser generator comprises a constantly radiating laser generator and an interruptor which is arranged in the path of rays between the laser generator and the photoelectric transducer and periodically interrupts the constant laser beam.

14. Apparatus in accordance with claim 13 wherein said interrupter comprises a mechanically operated interrupter in the form of an apertured disc.

15. Apparatus in accordance with claim 10 wherein said ray dividing means comprises a semi-transparent mirror which is positioned in the common path of the two beams of light rays at an angle with respect thereto.

16. Apparatus in accordance with claim 9 wherein said photoelectric transducer comprises a photo transistor.

17. Apparatus in accordance with claim 9 wherein said ray directing means comprises optical lenses and mirrors and including a pivotally mounted mirror for adjusting the position of the measuring spot on the printing cylinder.

18. Apparatus in accordance with claim 9 wherein said ray directing means at least partially comprises fiber optics.

19. Apparatus in accordance with claim 9 including ray distributing means disposed in the path of the two groups of rays for directing the incident beam of light rays towards different measuring spots on the surface of the printing cylinder and the corresponding reflected beam of light rays away from the surface of the printing cylinder, said measuring points being distributed along the axis of the printing cylinder.

20. Apparatus in accordance with claim 9, further comprising:

a ray interruptor (6), formed as a rotating toothed disc which is driven by a motor (**6*a*), said incident ray guiding means and said reflected ray guiding means further comprising, a collecting lens (5) which is arranged in the path of rays between said generator (3) and said interruptor (6) and which focuses the laser beam on the toothed periphery of said disc (6), a wide-opened lens system (7) which is arranged in the path of rays between said interruptor (6) and the measuring spot (M) on the printing cylinder (D) and which sharply focuses the laser beam which is focused in the plane of said interruptor (6**) on said measuring spot (M).

a diverting mirror (8) which is pivotally arranged in the path of rays between said lens system (7) and said measuring spot (M), a semi-transparent mirror (9) which is arranged in the path of rays between said interruptor (6) and said collecting lens (5) at an angle and which diverts the measuring beam which is reflected from said measuring spot (M), and said photoelectric transducer (4) receiving said diverted measuring beam on its receiving surface and delivering an electrical output signal which represents the intensity of said received measuring beam.

21. Apparatus as in claim 19 for determining the relative position between a doctor blade and a printing cylinder in a doctor blade rotogravure printing apparatus wherein:

said ray distributing means comprises a plurality of ray displacing pairs of mirrors of which a mirror situated in the path of the two groups of rays is common to all said pairs, while the other mirror of each pair is mounted to be swung in and out of alignment with the common mirror along an axis parallel to the axis of the printing cylinder.

22. A method for accurately and objectively controlling the relative position of a doctor blade with respect to a printing cylinder in a doctor blade rotogravure process comprising:

initially transferring ink onto a printing cylinder in surplus amounts;

stripping off all but a residual ink film by the doctor blade leaving engraved cells in said printing cylinder substantially loaded with ink and also leaving said residual ink film on the non-engraved portions of said cylinder;

generating a first beam of light, directing said first beam of light towards and onto said printing cylinder through said residual ink film at a measurement area in the non-engraved portion of said printing cylinder and causing said beam to be attenuated and scattered by its passage through said residual ink film to a degree dependent upon the thickness of said ink film, reflecting at least a portion of said first beam as a reflected second beam of light from the surface of said printing cylinder again through said residual ink film and causing said beam to again be attenuated and scattered by its repeated passage through said residual ink film to a degree which is also dependent upon the thickness of said ink film, collecting at least a portion of said reflected second beam, transducing said collected beam into an electrical signal having a characteristic representative of the intensity of said collected beam and hence representative of the thickness of said ink film, and controlling the relative position of said doctor blade in response to said electrical signal characteristic to maintain a desired thickness of said ink film and thereby to control and maintain the desired relative positioning of said doctor blade.

23. A method as in claim 22 wherein said generating step comprises the production of a monochromatic coherent laser light beam as said first beam of light.

24. A method as in claim 22 wherein said generating, directing, reflecting, collecting and transducing steps are repeated for a plurality of measurement areas distributed along the axial dimension of said printing cylinder.

25. A method as in claim 22 further including the step of periodically interrupting at least one of said first and second beams at a predetermined frequency thereby modulating said electrical signal at said frequency.

* * * * *